United States Patent [19]

Brandstetter

[11] Patent Number: 4,795,952

[45] Date of Patent: Jan. 3, 1989

[54] JOYSTICK FOR THREE AXIS CONTROL OF A POWERED ELEMENT

[75] Inventor: Robert W. Brandstetter, Fairborn, Ohio

[73] Assignee: The Warner & Swasey Company, Cleveland, Ohio

[21] Appl. No.: 161,313

[22] Filed: Feb. 23, 1988

Related U.S. Application Data

[63] Continuation of Ser. No. 868,858, May 12, 1986, abandoned.

[51] Int. Cl.[4] ..... G05G 13/00

[52] U.S. Cl. ..... 318/560; 73/862.05; 74/471 XY; 338/128

[58] Field of Search ..... 33/1 M; 73/862.05; 74/471 R, 471 XY; 200/6 A, 153 A, 157; 244/236, 237; 273/148 B; 338/2, 128; 340/709; 318/560

[56] References Cited

U.S. PATENT DOCUMENTS

| | | | |
|---|---|---|---|
| 2,984,720 | 5/1961 | Fisher | 74/471 XY |
| 3,306,125 | 2/1967 | Purcell et al. | 74/471 XY |
| 3,561,280 | 2/1971 | MacPhee | 73/862.04 |
| 3,639,705 | 2/1972 | Rayner | 200/6 A |
| 3,707,093 | 12/1972 | Worden | 200/6 A |
| 3,713,070 | 1/1973 | Sahlbecker | 200/157 |
| 3,749,871 | 7/1973 | Stoll | 200/156 |
| 3,772,484 | 11/1973 | Roeser | 200/4 |
| 3,835,270 | 9/1974 | Dufresne | 200/6 A |
| 3,917,918 | 11/1975 | Vannest et al. | 200/6 A |
| 4,040,647 | 8/1977 | F'Geppert | 280/766 |
| 4,046,005 | 9/1977 | Goroski | 244/236 |
| 4,085,301 | 4/1978 | Smith | 200/157 |
| 4,156,130 | 5/1979 | Ivashin et al. | 235/92 MP |
| 4,281,561 | 8/1981 | Groskopfs | 74/471 XY |
| 4,468,688 | 8/1984 | Gabriel | 358/22 |
| 4,533,899 | 8/1985 | Isaksson | 338/128 |
| 4,536,746 | 8/1985 | Gobeli | 73/862.05 |
| 4,555,960 | 12/1985 | King | 244/236 X |
| 4,584,510 | 4/1986 | Hollow | 200/157 X |
| 4,604,502 | 8/1986 | Thomas | 200/157 X |

FOREIGN PATENT DOCUMENTS

| | | | |
|---|---|---|---|
| 53-16184 | 2/1978 | Japan | 74/471 XY |
| 0201132 | 11/1983 | Japan | 340/709 |
| 0036843 | 2/1984 | Japan | 340/709 |
| 1560824 | 2/1980 | United Kingdom . | |

OTHER PUBLICATIONS

"MJ Series . . . Precise Control at a Finger's Touch", Bowmar Instrument Corp./Aerospace Div.; Fort Wayne, Ind.

Fox, J. E., "Keyboard Scanned Capacitive Joy Stick Cursor Control", IBM Tech. Disclosure Bulletin, vol. 23, No. 8, 1/1981, pp. 3831–3834.

*Primary Examiner*—Bentsu Ro

*Attorney, Agent, or Firm*—John R. Benefiel; Raymond J. Eifler

[57] ABSTRACT

A joystick controller (38) for three axis control of a powered element such as a probe shaft (24) of a coordinate measuring machine (10) is disclosed in which a joystick handle assembly (40) is mounted for pivoting movement along either of orthogonal horizontal X or Y axis, with a plunger (64) mounted within a hollow joystick shaft (58) for up and down movement along a vertical Z axis orthogonal to the X and Y axes. Control signal generators, such as potentiometer assemblies (84, 106, 134), are drivingly engaged with the hollow joystick shaft (58) and plunger (64), each generating control signals corresponding to each motion of the joystick handle assembly (40). These signals are used to produce corresponding controlled movement of the probe shaft (24) of the coordinate measuring machine (10) along respective X, Y and Z axes. In the first embodiment, the hollow joystick shaft (58) carries, at its lower end, a Z axis potentiometer assembly (106) which is operated by an actuator arm (112) engaged by the plunger (64). A gear rack (146) acting on rotary actuator gear (148) directly operates Z axis potentiometer assembly (106) in an alternate embodiment.

19 Claims, 5 Drawing Sheets

FIG-2A
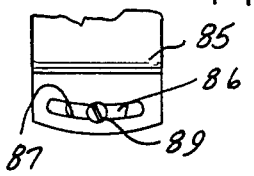
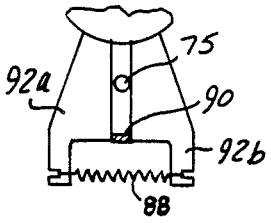
FIG-2B
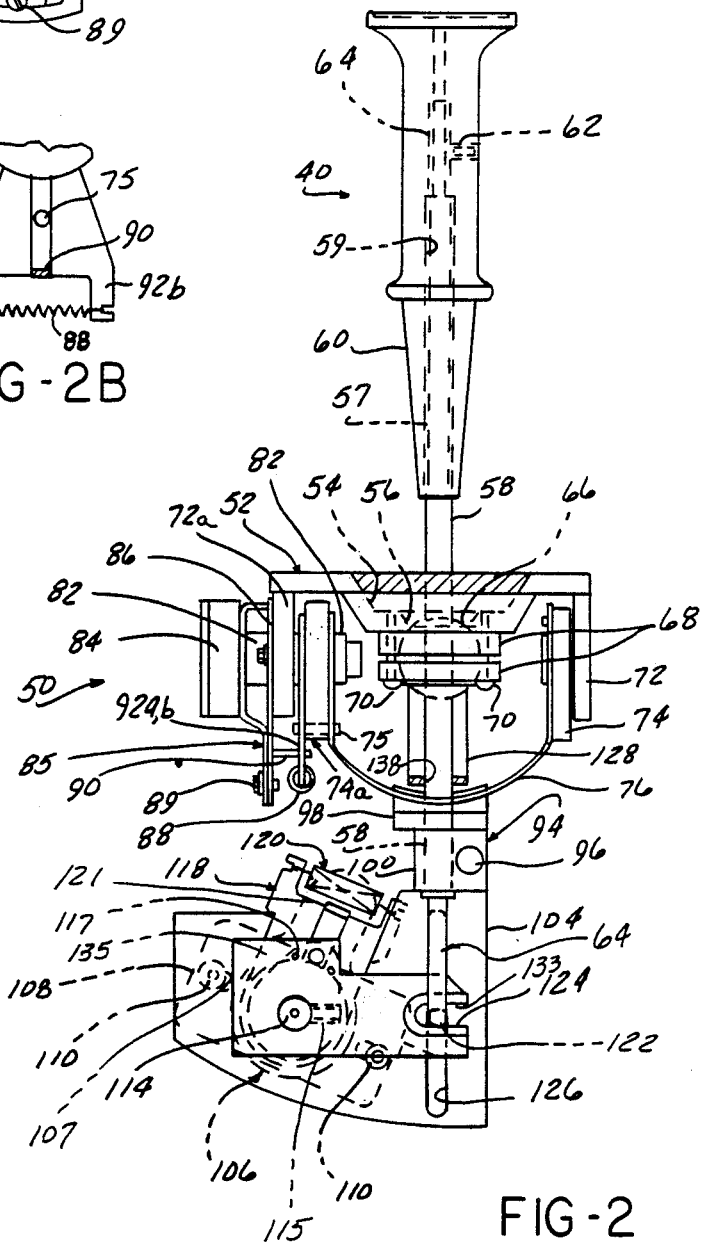
FIG-2

JOYSTICK FOR THREE AXIS CONTROL OF A POWERED ELEMENT

This application is a continuation of application Ser. No. 868,858, filed 5-12-86, now abandoned.

BACKGROUND OF THE INVENTION

This invention concerns joystick controllers and more particularly joystick controllers used to control X, Y and Z axis motion of a powered element, such as the probe shaft of a coordinate measuring machine, or the cutting tool of a three axis machine tool.

Coordinate measurement machines are known which utilize a probe shaft mounted for vertical movement on a carriage (referenced as Z axis motion), which carriage in turn is mounted for movement along two orthogonal axes in a horizontal plane (referenced as X—Y motion).

The probe shaft is provided with a tip which is adapted to contact points on an object supported on a table surface and, as the probe tip is moved along the X, Y, and Z-axes, measurements of the object are achieved by transducer means measuring this movement along each axis.

In some machines, the probe is powered to be driven to move from point to point about the object to be measured and it is necessary to provide a controller for the operator if the motion is manually controlled.

Joystick controllers have heretofore been known in which pivoting of a joystick shaft in either of two orthogonal directions produces corresponding X—Y movement of the probe shaft. A separate controller has been used to produce up-down motion of the probe shaft. Since the operator needs to activate a "record" button and operate two separate controllers, the process is somewhat cumbersome. Three axis controllers are also known in which a rotary motion is utilized to achieve a Z axis motion. In this instance, there is not instinctive corresponding movement of the controller joystick and the probe shaft, requiring significant experience for operator proficiency to be achieved.

With such controllers, it is necessary that a null position be reliably repeatable with a reasonable degree of accuracy and some means must be provided to preclude inadvertent motion in two axes as the joystick moves in the third direction.

SUMMARY OF THE INVENTION

The present invention comprises a joystick controller for coordinate measuring machines or machine tools in which a joystick shaft is mounted for tilting movement in either of two orthogonal directions with an operator graspable joystick handle assembly. The joystick handle assembly includes a component mounted for up-down movement in a direction aligned with the longitudinal axis of the handle. Each mode of joystick handle movement causes an associated X, Y, or Z axis signal generator such as a rotary potentiometer, to be actuated, to create corresponding control output signals. These signals are utilized to actuate the corresponding coordinate measuring machine or machine tool servo motors through suitable means.

The handle motion alone allows motion control along all three axes, and this motion of the joystick handle closely corresponds to the resulting motion of the probe shaft or cutting tool. A high degree of operator proficiency is thus readily achievable.

In a first embodiment, the joystick shaft moves through slots in orthogonally arranged bails, which operates respective potentiometers, utilized to generate electrical control signals corresponding to the position of the joystick in either direction, in a manner known in the art. However, an inner plunger is attached to a joystick handle slidably received over the upper end of the joystick shaft. The inner plunger extends downwardly out of the joystick shaft and at its lower end drivingly engages an operator arm of a Z axis potentiometer assembly atached to the lower end of the joystick shaft. Up and down motion of the joystick handle and inner plunger actuates the Z axis potentiometer through the arm, with a centering mechanism associated with the potentiometer wiper to establish a precise null position.

In a second embodiment, the inner plunger directly actuates the Z axis potentiometer by a gear rack, and opposed centering springs are arranged in the joystick handle, attached to the joystick shaft, to center the plunger itself in a null position, with the plunger operated by an attached separate operating ring located above the joystick handle.

An advantage of the joystick controller according to the present invention is that three axis motion control is achieved by motion of the controller which corresponds to the three axis motion of the probe shaft of a coordinate measuring machine or the cutting tool of the machine tool.

Another advantage of the joystick controller according to the present invention is that a reliable, accurately repeatable Z axis nulling of the joystick position is achieved.

Another advantage of the joystick controller according to the present invention is that a pre-loaded null is maintained in the X, Y, and Z-axes such that an operator may easily actuate one axis without inadvertently operating the two remaining axes.

BRIEF DESCRIPTION OF THE DRAWINGS

FIG. 2 is a side elevational enlarged view of a joystick assembly incorporated in the joystick controller shown in FIG. 1.

FIG. 2A is a fragmentary endwise view of the mounted X axis potentiometer shown in FIG. 2.

FIG. 2B is a fragmentary endwise view of the centering spring for the X axis potentiometer shown in FIG. 2.

DESCRIPTION OF THE PREFERRED EMBODIMENTS

Figure 1:
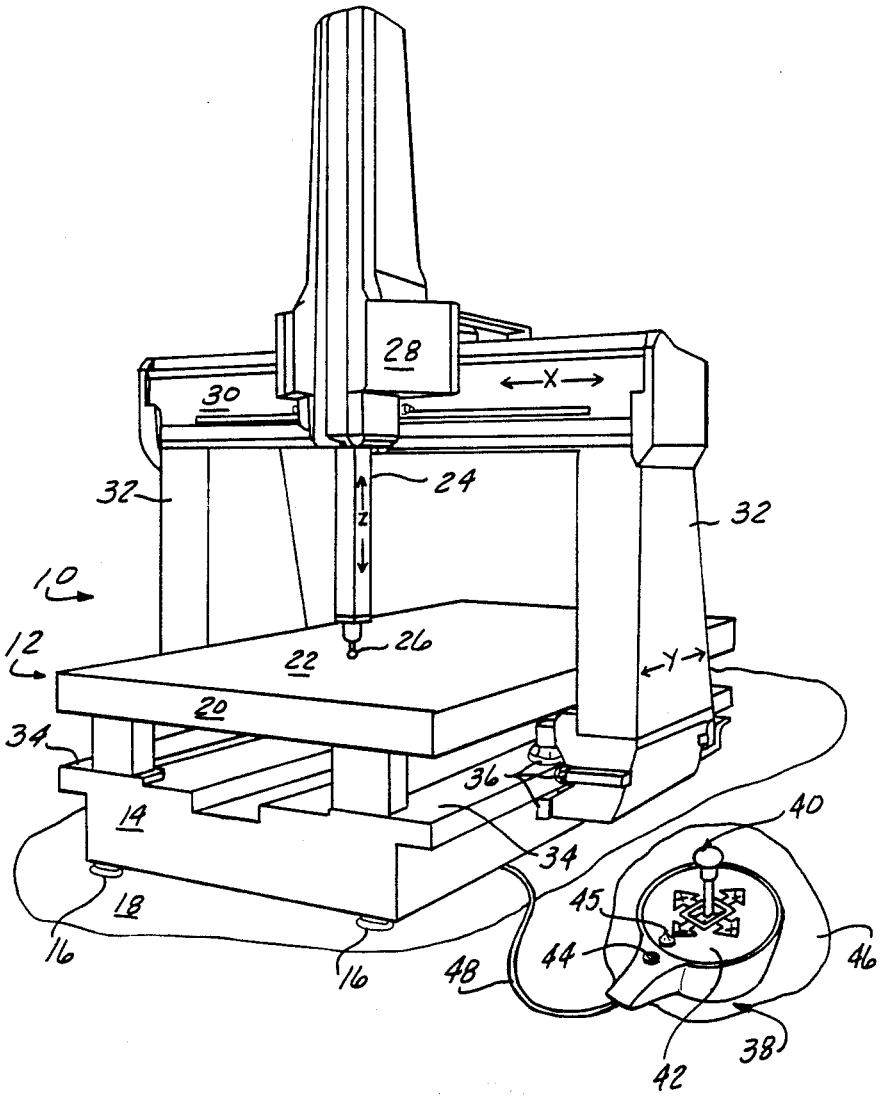
FIG. 1 is a perspective view of a coordinate measuring machine and joystick controller according to the present invention.

FIG. 1 shows a coordinate measuring machine 10, including a base 12 having a bottom portion 14 having feet 16 adapted to rest on a supporting surface 18. The base 12 also includes a table portion 20 having an upper surface 22 adapted to support an object to be measured.

A probe shaft 24 having a probe tip 26 is adapted to be moved to allow the probe tip 26 to be placed in contact with points of interest on an object to be measured. The probe shaft 24 is supported for movement along a first horizontal, or X axis, by being mounted on a carriage 28 moveably mounted on an X-beam 30. X-beam 30 is mounted on the upper ends of upstanding members 32 located on either side of the table portion 20. The lower ends of members 32 are supported on ways 34 affixed to the base 12 which extend orthogonally to the X-beam 30 and by bearings 36 which establish guided movement of the X-beam 30 along a second horizontal, or Y axis.

The probe shaft 24 is also mounted for vertical movement on carriage 28 by a suitable conventional arrangement, the details of which are not shown in FIG. 1.

Thus, the probe shaft 24 is moveable along three orthogonal axes such that the probe tip 26 can be moved in three dimensions about an object on the upper table surface 22, to measure points of interest, in the manner well known to those skilled in the art.

The joystick controller 38 according to the present invention is adapted to enable operator controlled powered movement of the probe shaft 22 upwardly from a central location of a controller housing 42.

A "record" button 44 is also provided to electrically control a measurement point as well as an emergency stop button 45, each acting in the manner well known in the art.

The joystick handle assembly 40 is mounted to be tilted back and forth along either of two orthogonally related axes from a central null position, with the axis of each lying in a horizontal plane with controller housing 42 resting on a horizontal support surface 46.

The joystick handle assembly 40 is also able to be moved up and down along a third orthogonal, or Z axis, aligned with its longitudinal axis.

Signal generator means are associated with each mode of movement of the joystick handle assembly 40, as will be described, to generate electrical signals corresponding to the extent and direction of movement along each axis from a central null position. These signals are transmitted to the coordinate measuring machine 10 via a cable 48, which may also carry leads from the record button 44, and cause respective drive motors to be energized to drive the X-beam 30, carriage 28, or probe shaft 24 in a corresponding direction and at a velocity corresponding to the extent of movement from the null position along the particular axis.

It can be appreciated from viewing FIG. 1 that the movement of the joystick handle assembly 40 closely corresponds to movement of the probe shaft 24 such that an operator can readily achieve a high degree of proficiency.

FIG. 2 illustrates the joystick assembly 50 incorporated in the joystick controller 39 of FIG. 1. The details of the X and Y axis components are well known in the art, but are here described for the sake of clarity. Joystick assembly 50 includes a body member 52 adapted to be mounted to the controller housing 42 shown in FIG. 1, having a central depressed region 54 with centered opening 56 through which extends a hollow joystick shaft 58.

The joystick handle assembly 40 includes a joystick handle member 60 slidably mounted on the upper end 57 of the hollow joystick shaft 58 received in a corresponding bore 59. The upper end of plunger 64 extends within the hollow joystick shaft 58 and is attached to the joystick handle member 60 by set screw 62 and by screw threads on joystick handle member 60 and plunger 64 respectively.

Attached to the joystick handle member 60 is a pivot ball 66 mounted between a pair of ball socket members 68 secured to the underside of depressed region 54 by screws 70. Pivot ball 66 is allowed to pivot in ball socket members 68 to allow tilting movement of the hollow joystick shaft 58 and joystick handle member 60 along the X and Y axis.

Figure 3:
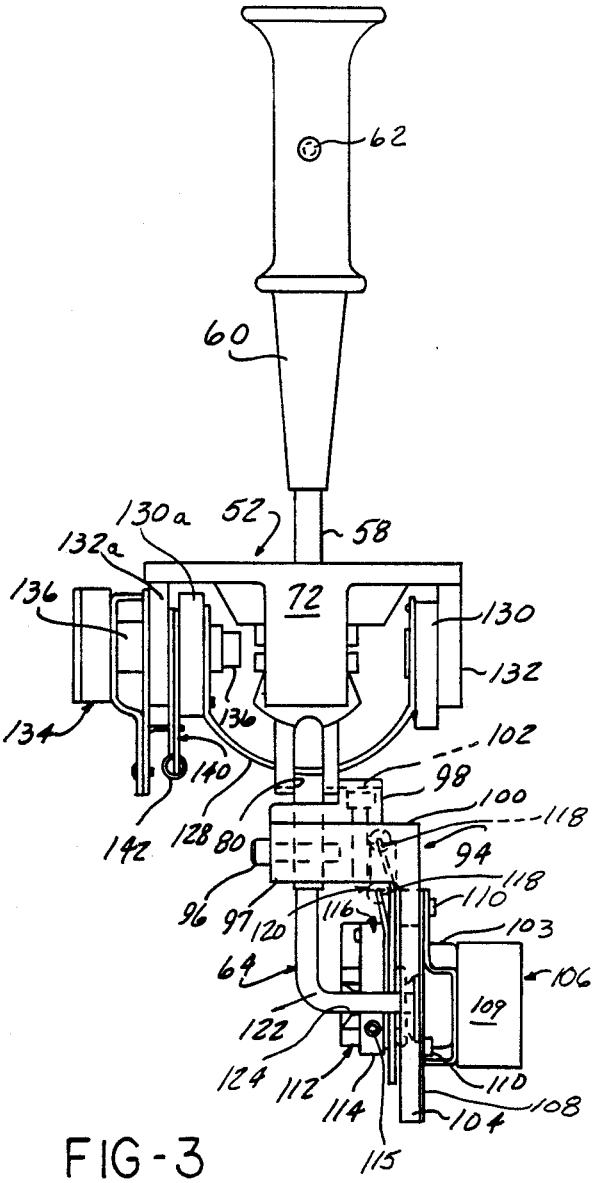
FIG. 3 is a front elevational view of a joystick assembly incorporated in the joystick controller shown in FIG. 1.

The body member 52 includes a pair of spaced side plates 72 on which are pivotally mounted hubs 74, in turn having affixed thereto either end of curved X axis bail 76 having a central slot 80 extending transversely to the X axis (FIG. 3).

The intermediate section of the hollow joystick shaft 58 passes through the central slot 80 which thereby accommodates Y axis tilting motion of the hollow joystick shaft 58 parallel to central slot 80, with no corresponding movement of the X axis bail 76. Thus, X axis tilt transverse to the central slot 80 causes corresponding rotation of the X axis bail 76 and hubs 74.

The hub 74*a* to the left as viewed in FIG. 2 is attached to the protruding wiper end portion 82 of the X axis rotary potentiometer assembly 84, which is affixed to the side plate 72*a* to the left as viewed in FIG. 2 by a mounting plate 86 and a flange 85, flange 85 rotatably fixed to the X axis rotary potentiometer assembly 84. Thus the X axis bail 76 constitutes means drivingly connecting the hollow joystick shaft 58 with the X axis rotary potentiometer assembly 84 to cause the wiper end portion 82 to be rotated upon X axis tilting movement thereof.

FIG. 2A shows that screw 89 passes through a slot 87 in flange 85 and is threadably received in a tapped hole in mounting plate 86 to allow adjustable anchoring of X axis rotary potentiometer assembly 84 in adjusted angular positions.

FIG. 2B shows that a centering spring 88 is mounted across pivoted legs 92*a* and 92*b*, which each act on a pin 75 carried by hub 74*a* to bias the wiper end portion 82 to a null position against a fixed stop tab 90 formed in mounting plate 86. Centering spring 88, acting on each leg 92*a*, 92*b*, acts to resist rotation of X axis bail 76 therefrom in either direction.

A bracket 94 is clamped to the lower end of hollow joystick shaft 58 by cap screw 96 extending through split clamping webs 97 (FIG. 3) so as to be mounted for movement therewith as the joystick handle assembly 40 is tilted along the X or Y axis.

A key plate 98 is affixed to the upper surface of top plate 100 forming part of the bracket 94 with cap screw 102, key plate 98 extending along X axis bail 76 to prevent rotation of bracket 94 on the hollow joystick shaft 58.

FIGS. 2 and 3 show that top plate 100 extends laterally to offset a side plate 104 integral with bracket 94, to which is mounted Z axis signal generator means comprised of a Z axis potentiometer assembly 106, by mounting plate 108 and screws 110 passing through elongated openings 107 in mounting plate 108. The Z axis potentiometer assembly 106 passes through a slot 135 cut into the side plate 104.

Figure 3A:
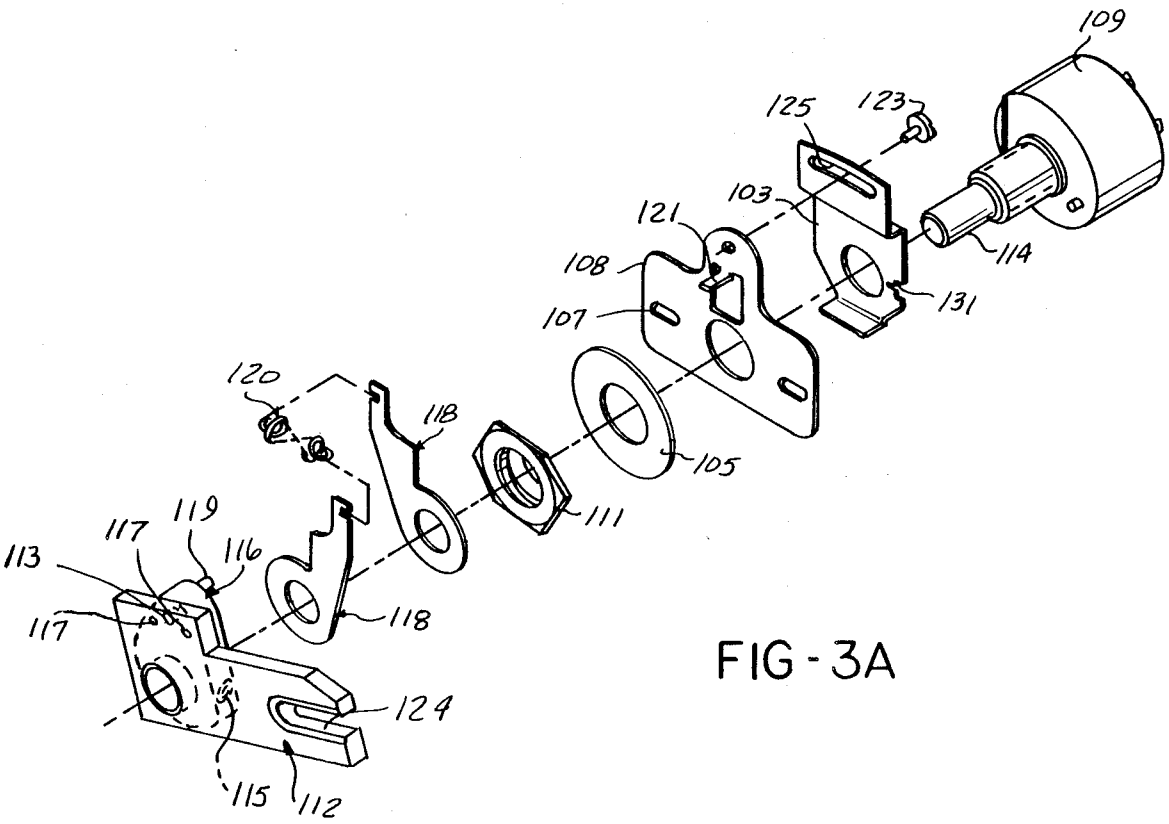
FIG. 3A is an exploded perspective view of the Z axis potentiometer assembly and associated actuator components included in the joystick controller shown in FIGS. 2 and 3.

FIG. 3A shows the components of the Z axis potentiometer assembly 106, which is typical of each of the X, Y and Z axis potentiometers, and includes a rotary potentiometer 109 having a protruding wiper shaft 114 passing through openings in a flange 103, mounting plate 108, washer 105 and threaded to receive retainer nut 111. Wiper shaft 114 also passes through openings in centering legs 118, and an actuator arm 112 and a potentiometer actuating element 116 secured to actuator arm 112 with screws 117.

The Z axis potentiometer assembly 106 is actuated by an actuator arm 112 and a potentiometer actuating element 116 secured thereto with screws 117 and pin 113.

The potentiometer actuating element 116 is locked to the wiper shaft 114 with a set screw 115, while a drive pin 119 passes between centering legs 118. A centering spring 120 is attached to either leg 118 biasing them against a tab 121 passing therebetween, tab 121 formed integrally with mounting plate 108. A locking screw 123 passes through an arced slot 125 and into threaded hole 127 to allow angular adjustment of the rotary potentiometer 109. Pin 129 of rotary potentiometer 109 extends into slot 131 of flange 103 to fix these components together. FIG. 3 shows that legs 118 are bent to locate the centering spring 120 to clear side plate 104 during pivoting movement of the actuator arm 112.

An endwise slot 124 is formed in the end of the actuator arm 112, which in turn is engaged by the angled end 122 of the plunger 64, so that means are provided for causing rotation of the actuator arm 112 to be produced by up and down movement of the plunger 64.

The angled end 122 of plunger 64 extends into a vertical slot 126 formed through plate side 104 extending to accommodate the full up and down travel of the plunger 64, to maintain the orientation of the angled end 122 and its engagement with endwise slot 124 throughout its range of movement.

FIG. 3 also shows that a Y axis bail 128 is also provided, having its ends fastened to hubs 130, each pivotally mounted to side plates 132 of body member 52. A Y axis potentiometer assembly 134 is mounted to the side plate 132*a*, on the left with a potentiometer wiper 136 secured to hub 130*a* on the left so as to be rotated by the Y axis bail 128 as it pivots with hubs 130. This arrangement provides means for drivingly connecting the hollow joystick shaft 58 and Y axis potentiometer assembly 134.

Y axis bail 128 is slotted at 138 (FIG. 2), to allow passage of the hollow joystick shaft 58 therethrough, and to accommodate movement of the X axis potentiometer assembly 84.

A centering spring assembly 140 including a centering spring 142 is also included to bias the potentiometer wiper 136 to a null position, resisting rotation in either direction.

Thus, the joystick handle assembly 40 may be independently titled in either direction along the X or Y axis, and an electrical control signal generated by the respective X or Y axis potentiometer assemblies 84 or 134, in conventional fashion.

However, upon up or down movement of the joystick handle assembly 40, the plunger 64 is caused to move up or down and actuate the Z axis potentiometer assembly 106 to generate corresponding control signals. Thus, the handle motion corresponds closely to the desired motion of the probe shaft 24.

Figure 4:
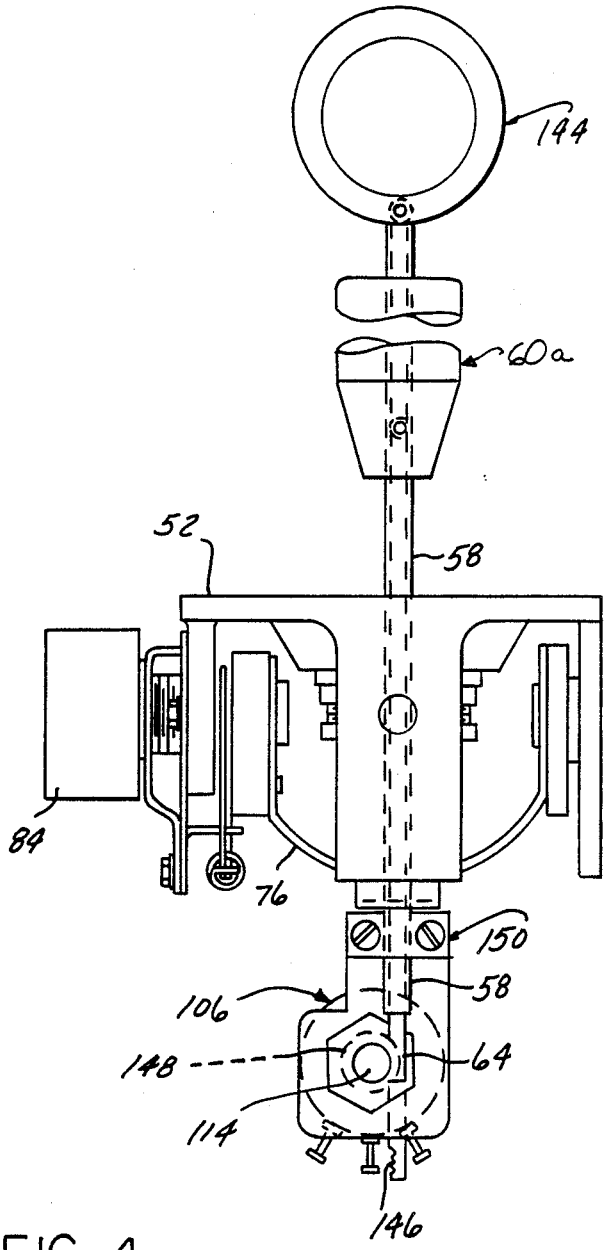
FIG. 4 is a side elevational enlarged view of an alternate embodiment of a joystick assembly for a joystick controller according to the present invention.

FIG. 4 illustrates an alternate arrangement in which the plunger 64 extends through the separate joystick handle member 60*a* and is affixed to another handle member comprised of an operator ring 144 included in the joystick handle assembly 40 which may receive an operator's thumb at the same time as the joystick handle assembly 40 is grasped.

Plunger 64 extends through the lower end of hollow joystick shaft 58 clamped to bracket 150, and is formed at its lower end with a gear rack 146 mating with a rotary actuator gear 148 secured to the wiper shaft 114 of Z axis potentiometer assembly 106. Up and down movement of the plunger 64 thus causes rotation of the wiper shaft 114 by means of the gear rack 146 and rotary actuator gear 148 and generation of corresponding control signals, as in the previously described embodiment.

Figure 5:
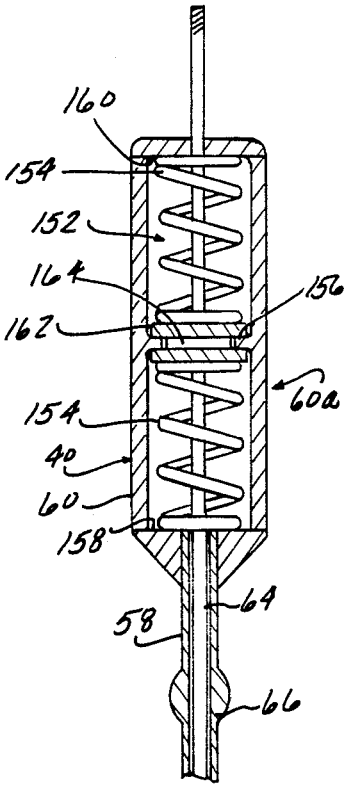
FIG. 5 is a partially sectional enlarged view of a joystick handle and plunger components incorporated in the joystick assembly shown in FIG. 4.

FIG. 5 illustrates the centering arrangement for biasing the plunger 64 to a null position, which arrangement is contained within a cavity 152 in the separate joystick handle member 60*a*.

The plunger 64 extends entirely through the cavity 152 within a pair of opposing centering springs 154 positioned above and below a feature comprised of a web 156, with one end seated against a respective end wall 158 and 160 of joystick handle member 60.

A pair of washers 162 are interposed between a respective other end of each centering springs 154 and one side of web 156.

The plunger 64 is formed with a feature comprised of an intermediate shoulder 164 of the same thickness as web 156 such that plunger 64 is biased to a null position in which the intermediate shoulder 164 is vertically aligned with the web 156 by the centering springs 154 acting through washers 162.

Thus, centering means are thereby provided so that plunger 64 may be accurately returned to a null centered position, and is able to resist inadvertent movement away from this position as the joystick handle assembly 40 is tilted along the X or Y axis.

It should be appreciated that the joystick controller 38 according to the present invention is useable with coordinate measuring machines of many different configurations than the machine described herein, or with other machine tool machines by which three axis controlled movement of tools is achieved.

I claim:

1. A joystick controller for three axis control of a powered element including a joystick handle assembly (40) mounted for tilting movement in any direction in a plane defined by two orthogonal X and Y axis from a null position with respective X and Y axis rotary potentiometers (84, 134) producing X-Y plane control signals corresponding to the extent of tilting movement of said handle assembly along either axis, characterized by said joystick handle assembly (40) including a handle member (60) mounted for up-and-down movement along a Z-axis from a centered null position and a Z-axis rotary potentiometer (106) having an input wiper member (14) drivingly connected to said handle member (60,) to produce a control signal corresponding to said up-and-down movement of said handle member (60,);

a hollow joystick shaft (58) fixed against up-and-down movement into the X-Y plane but pivotable in any direction in said X-Y plane; means (76, 128) drivingly engaging each of said X and Y axis rotary potentiometers (84, 134) with said hollow joystick shaft (58) to produce said X-Y plane control signals;

said joystick handle assembly (40) handle member 60 having a bore (59) received over said hollow joystick shaft (58) to be slidably fit thereto enabling up and down sliding movement of said handle member (60) on said hollow joystick shaft (58), said handle member (60) extending along the length of said hollow joystick shaft (58);

means (94, 150) mounting said Z-axis potentiometer to the lower end of said hollow joystick shaft (58) so as to be carried therewith upon tilting of said hollow joystick shaft (58);

a plunger (64) slidably fit within said hollow joystick shaft (58) to be movable in and out of the X-Y plane independently of said tilting movement of said handle assembly, the lower end of said plunger (64) passing out of the lower end of said hollow joystick shaft (58), and the upper end of said plunger (64) protuding above the upper end of said hollow joystick shaft (58) and received within and fixed to said handle member (60), and means (112, 146) drivingly engaging said input wiper member (114) of said Z-axis potentiometer (106) with said lower end of said plunger (64) to cause corresponding movement of said wiper member (114) to an extent corresponding to the extent of movement of said plunger 64 from said centered null position; and, nulling spring means (88, 142, 120) associated with each of said X, Y and Z axes potentiometers (84, 134, 106) acting to bias said hollow joystick shaft (58) to said X and Y axis null position and said plunger (64) to said up-and-down centered null position.

2. The joystick controller according to claim 1 wherein said means mounting said Z-axis rotary potentiometer (106) includes a bracket (94, 150) secured to said joystick shaft (58), wherein said Z-axis rotary potentiometer (106) is mounted to said bracket (94, 150) to tilt with said joystick shaft (58).

3. The joystick controller according to claim 2 further including an actuator arm (112) engaged with said Z-axis rotary potentiometer (106) to produce said up-and-down movement control signal upon pivoting of said actuator arm (112), and means (122, 124) drivingly engaging said plunger (64) with said actuator arm (112) to produce pivoting movement thereof upon up-and-down movement of said plunger (64).

4. The joystick controller (38) according to claim 3 wherein said means drivingly engaging said plunger (64) with said actuator arm (112) includes an angled end (122) formed on said plunger (64) and an endwise slot (124) formed in said actuator (112), said angled end (122) extending into said endwise slot (124).

5. The joystick controller (38) according to claim 4 wherein said bracket (94) includes a vertical slot (126) formed therein, and wherein said angled end (122) extends into said vertical slot (126) after passing through said endwise slot (124).

6. A joystick controller for three axis control of a powered element including a joystick handle assembly (40) mounted for tilting movement in any direction in a plane defined by two orthogonal X and Y axis from a null position with respective X and Y axis rotary potentiometers (84, 134) producing X-Y plane control signals corresponding to the extent of tilting movement of said handle assembly along either axis, characterized by said joystick handle assembly (40) including a (first handle member) (144) mounted for up-and-down movement along a Z-axis from a centered null position and a Z-axis potentiometer (106) having an input wiper member (14) drivingly connected to said first handle member (144) to produce a control signal corresponding to said up-and-down movement of said first handle member (144);

a hollow joystick shaft (58) fixed against up-and-down movement into the X-Y plane but pivotable in any direction in said X-Y plane; means (76, 128) drivingly engaging each of said X and Y axis rotary potentiometers (84, 134) with said hollow joystick shaft (58) to produce said X-Y plane control signals;

said joystick handle assembly (40) also having a second handle member (60*a*) fixed to said hollow joystick shaft (58), said first handle member (144) located immediately above said second handle member (60*a*) to be able to be engaged with the thumb of a user's hand grasping said second handle member (60*a*); means (94, 150) mounting said Z-axis potentiometer to the lower end of said hollow joystick shaft (58);

a plunger (64) affixed to said first handle member (144) to move up and down therewith, said plunger (64) slidable within said hollow joystick shaft (58) to be movable in and out of the X-Y plane independently of said tilting movement of said handle assembly, the lower end of said plunger (64) passing out of the lower end of said hollow joystick shaft (58), and the upper end extending above said second handle member (60*a*), and means (112, 146) drivingly engaging said input wiper member (114) of said Z-axis potentiometer (106) with said lower end of said plunger (64) to cause corresponding movement of said wiper member (114) to an extent corresponding to the extent of movement of said plugner 64 from said centered null position; and, nulling spring means (88, 142, 120) associated with each of said X, Y, and Z axes potentiometers (84, 134, 106) acting to bias said hollow joystick shaft (58) to said X and Y axis null position and said plunger (64) to said up-and-down centered null position.

7. The joystick controller (38) according to claim 6 wherein said plunger (64) extends within said second handle member (60*a*) and further including centering means (154, 156, 162, 164) located within said second handle member (60*a*) and acting on said plunger (64) to bias said plunger (64) to said centered null position.

8. The joystick controller (38) according to claim 7 wherein said centering means includes vertically opposing centering springs (154) acting on said plunger (64).

9. The joystick controller (38) according to claim 8 wherein said centering means further includes an intermediate feature (156) fixed to said second handle member (60*a*), a feature (164) on said plunger (64), each of said features acted on by opposing centering springs (154) to bias said plunger (64) to a position whereat said features are vertically aligned, said position constituting said centered null position.

10. The joystick controller (38) according to claim 9 including a gear rack (146) carried by said plunger (64) and a rotary actuator gear (148) engaged by said gear rack (146), rotation of said rotary actuator gear (148) is produced by said up and down motion of said plunger (64).

11. The joystick controller (38) according to claim 7 wherein said first handle member comprises an operator ring (144) attached to said plunger (64) and located above said first handle member (60*a*).

12. A joystick controller for three axis control of a powered element including a joystick handle assembly

(40) comprised of surfaces grippable by the fingers and hand of a user, mounted for tilting movement in any direction in a plane defined by two orthogonal X and Y axis from a null position with respective X and Y axis rotary potentiometers (84, 134) producing X-Y plane control signals corresponding to the extent of tilting mvoement of said handle assembly (40) along either axis, characterized by:

an upright, elongated hollow joystick shaft (58) received by said handle assembly (40) and fixed against up-and-down down movement into X-Y plane but pivotable in any direction in said X-Y plane; means (76, 128) drivingly engaging each of said X and Y axis rotary potentiometers (84, 134) with said hollow joystick shaft (58) to produce said X-Y plane control signals upon tilting of said hollow joystick shaft (58);

said joystick handle asembly (40) including a handle member (60) having a bore (59) received over said hollow joystick shaft (58), said handle member (60) extending along said hollow joystick shaft (58);

a Z-axis potentiometer (106) mounted to a lower end of said hollow joystick shaft (58) so as to be carried therewith upon tilting of said hollow joystick shaft (58);

an elongated plunger (64) slidably fit within said hollow joystick shaft (58) so as to be movable up and down from a vertically centered null position independently of said tilting movement of said handle assembly (40) and hollow joystick shaft (59), the lower end of said plunger (64) passing out of the lower end of said hollow joystick shaft (58), and the upper end of said plunger (64) protruding above the upper end of said hollow joystick shaft (58) and drivingly connected to said handle assembly (40) and means (112, 146) drivingly engaging an input wiper member (114) of said Z-axis potentiometer (106) with said lower end of said plunger (64) t cause corresponding movement of said wiper member (114) to an extent corresponding to the extent of movement of said plunger (64) from said centered null position; and, nulling spring means (88, 142, 120) associated with each of said X, Y, and Z axes potentiometers (84, 134, 106) acting to bias said hollow joystick shaft (58) to said X and Y axis null position and said plunger (64) to said vertically centered null position.

13. The joystick controller according to claim 12 wherein said handle member (60) is slidably mounted over said joystick shaft (58) and attached to said plunger (64).

14. The joystick controller according to claim 12 wherein said handle assembly (40) includes a separately movable handle member (144) located above said handle member (60*a*) and attached to said plunger (64), said handle member (60*a*) attached to said hollow joystick shaft (58).

15. The joystick controller according to claim 14 wherein said plunger (64) extends within said handle member (60*a*) and further including centering means (154, 156, 162, 164) located within said handle member (60*a*) and acting on said plunger (64) to bias said plunger (64) to said vertically centered null position.

16. The joystick controller according to claim 15 wherein said centering means includes vertically opposing centering springs (154) acting on said plunger (64).

17. The joystick controller according to claim 16 wherein said centering means further includes an intermediate feature (156) fixed to said handle member (60*a*) and a feature (164) on said plunger (64), each of said features (156, 164) acted on by said opposing centering springs (154) to bias said plunger (64) to a position whereat said features are vertically aligned, said position constituting said vertically centered null position.

18. The joystick controller according to claim 17 including a gear rack (146) carried by said plunger (64) and a rotary gear (148) engaged by said gear rack (146), rotation of said rotary gear (148) is produced by said up-and-down motion of said plunger (64).

19. The joystick controller according to claim 15 wherein said separately movable handle member comprises a ring (144) attached to said plunger (64) and located above said handle member (60*a*).

* * * * *